US009718293B1

(12) United States Patent
Shih

(10) Patent No.: US 9,718,293 B1
(45) Date of Patent: Aug. 1, 2017

(54) EMBOSSING SEAL

(71) Applicant: SUN SAME ENTERPRISES CO., LTD., Tainan (TW)

(72) Inventor: Wen-Jer Shih, Tainan (TW)

(73) Assignee: Sun Same Enterprises Co., Ltd., Tainan (TW)

( * ) Notice: Subject to any disclaimer, the term of this patent is extended or adjusted under 35 U.S.C. 154(b) by 0 days.

(21) Appl. No.: 15/225,996

(22) Filed: Aug. 2, 2016

(51) Int. Cl.
*B44B 5/00* (2006.01)
*B41K 3/36* (2006.01)

(52) U.S. Cl.
CPC ..... *B41K 3/36* (2013.01); *B44B 5/0052* (2013.01); *B44B 5/0085* (2013.01)

(58) Field of Classification Search
CPC .... B41K 3/02; B41K 3/36; B41K 3/62; B44B 5/0023; B44B 5/0038; B44B 5/0052; B44B 5/0085; B44B 5/026
USPC ..... 101/31.1
See application file for complete search history.

(56) References Cited

U.S. PATENT DOCUMENTS 286,496 A * 10/1883 Smith ..... B44B 5/0085 101/31.1
1,055,494 A * 3/1913 Ryan ..... C14B 5/00 101/31.1
1,442,201 A 1/1923 Weber et al.
1,506,512 A 8/1924 Wenthe
2,202,255 A * 5/1940 Jackson ..... B41K 3/36 100/231

FOREIGN PATENT DOCUMENTS

DE 44145 8/1888
DE 183533 4/1907
DE 184520 5/1907
GB 437540 A * 10/1935 ..... B44B 5/0085

* cited by examiner

*Primary Examiner* — Leslie J Evanisko
(74) *Attorney, Agent, or Firm* — Rosenberg, Klein & Lee

(57) ABSTRACT

An embossing seal has a base, a die assembly, a driven shaft assembly, a restoring member, and a pressing handle. The die assembly is mounted in the base. The driven shaft assembly is movably mounted in the base, abuts the die assembly, and has a lower shaft unit, an upper shaft unit, and a cushion member, so as to perform two embossing steps. The restoring member is mounted in the base and abuts the base and the upper shaft unit. The pressing handle is pivotally coupled to the base and abuts the upper shaft unit. With the upper shaft unit driving the lower shaft unit via the cushion member, discomfort to the wrist and elbow of a user can be reduced.

13 Claims, 6 Drawing Sheets

EMBOSSING SEAL

BACKGROUND OF THE INVENTION

1. Field of the Invention

The present invention relates to an embossing seal, especially to an embossing seal that allows a user to hold and to form embossed patterns.

2. Description of the Prior Art(s)

A conventional embossing seal comprises a pressing assembly and a die assembly. The pressing assembly includes a base, a shaft, and a pressing handle. The base has a mounting recess formed in a front end of the base. The shaft is mounted in the base and is able to move up and down relative to the base. The shaft has a lower end protruding into the mounting recess. The pressing handle is pivotally coupled to the base and selectively drives the shaft to move. The die assembly is mounted in the mounting recess of the base and includes an upper die. The upper die is abutted by the lower end of the shaft.

During embossing, a material that is intended to be embossed is mounted in the die assembly and a user holds and turns the pressing handle. Thus, the pressing handle provides a downward pressure to the shaft and the shaft moves downward to push the upper die of the die assembly. Accordingly, the upper die forms embossed patterns on the material.

However, when the user turns the pressing handle with his wrist and elbow and the pressing handle directly pushes the shaft to move downward, the collision between the pressing handle, the shaft, and the upper die that are all solid causes discomfort to the wrist and the elbow of the user.

To overcome the shortcomings, the present invention provides an embossing seal to mitigate or obviate the aforementioned problems.

SUMMARY OF THE INVENTION

The main objective of the present invention is to provide an embossing seal. The embossing seal has a base, a die assembly, a driven shaft assembly, a restoring member, and a pressing handle. The die assembly is mounted in the base. The driven shaft assembly is movably mounted in the base, abuts against the die assembly, and has a lower shaft unit, an upper shaft unit, and a cushion member, so as to perform two embossing steps. The restoring member is mounted in the base and abuts against the base and the upper shaft unit. The pressing handle is pivotally coupled to the base and abuts against the upper shaft unit.

During a first embossing step, with the upper shaft unit drives the lower shaft unit via the cushion member, discomfort of wrist and elbow of a user can be reduced. Accordingly, the user can operate the embossing seal in a comfortable and labor saving manner.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
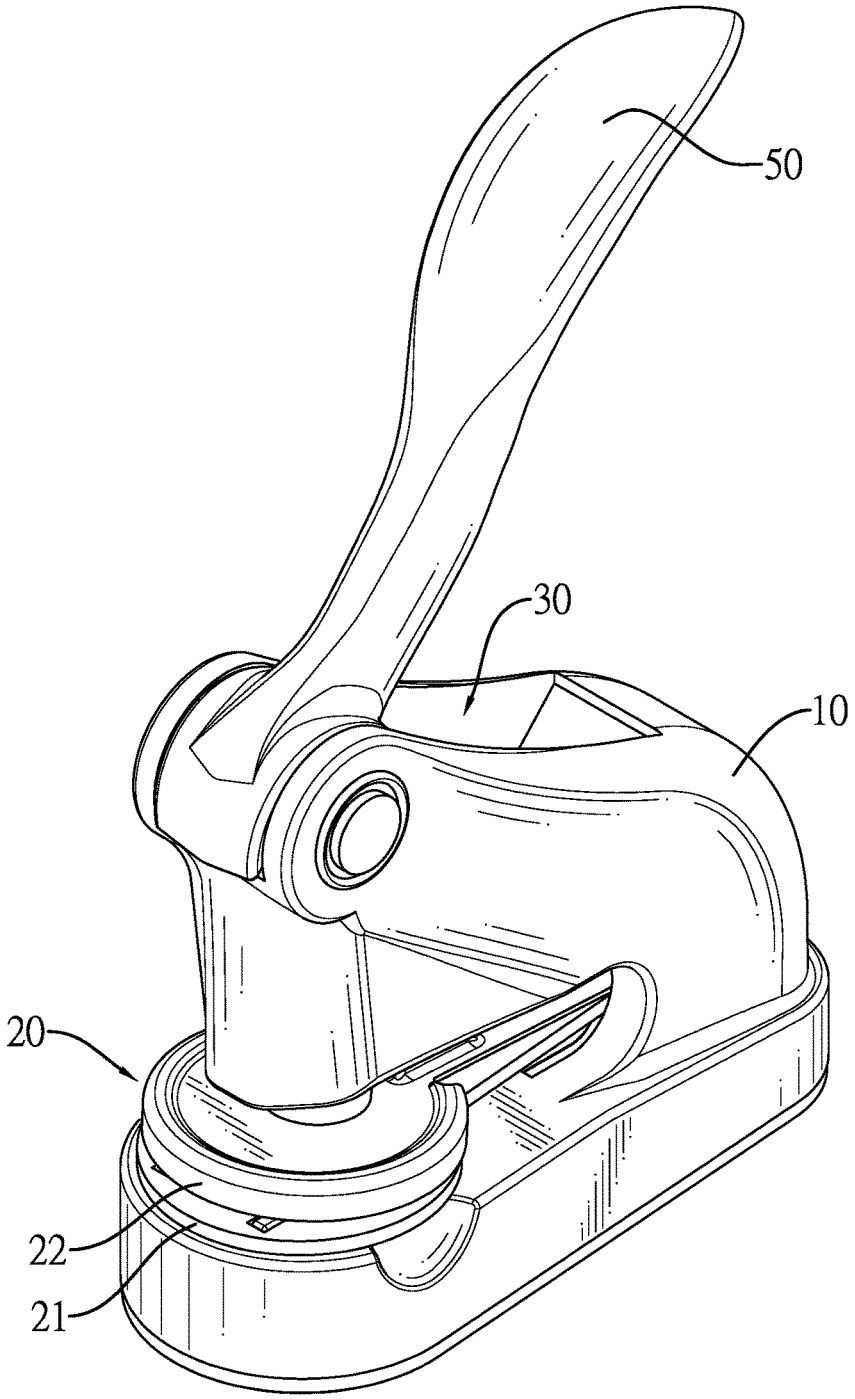
FIG. 1 is a perspective view of an embossing seal in accordance with the present invention.
Figure 2:
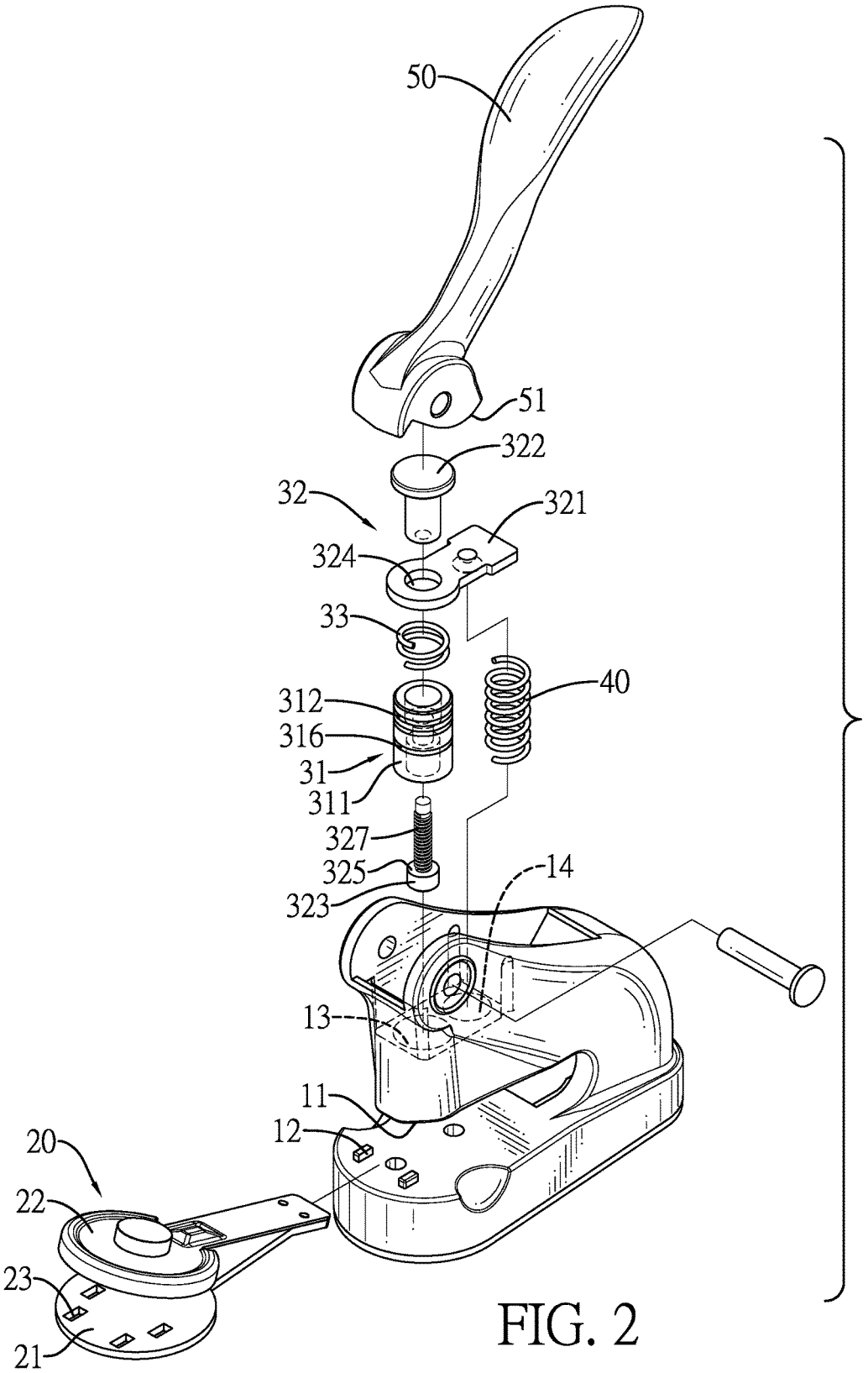
FIG. 2 is an exploded perspective view of the embossing seal in FIG. 1.
Figure 3:
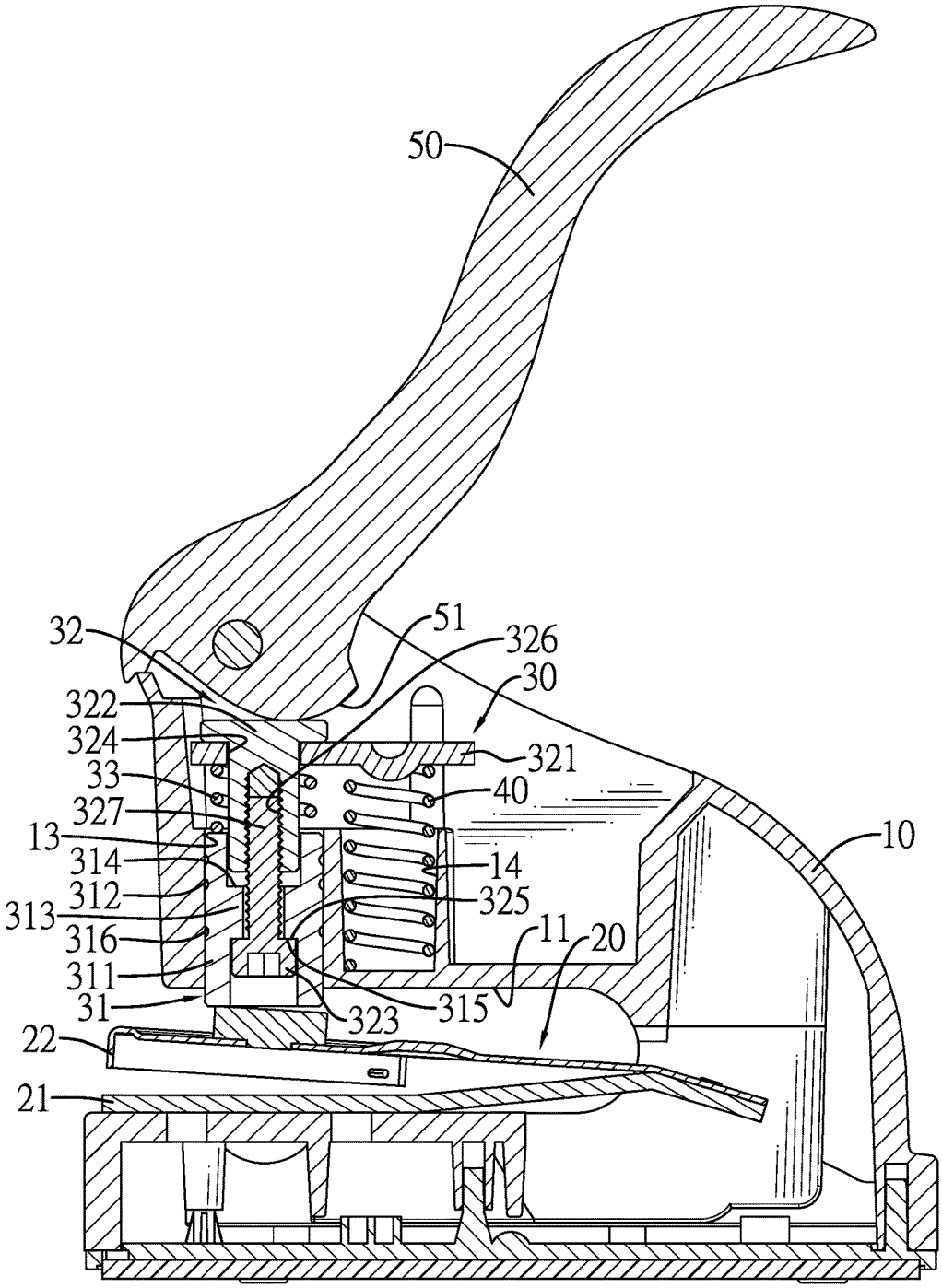
FIG. 3 is a cross-sectional side view of the embossing seal in FIG. 1.

With reference to FIGS. 1 to 3, an embossing seal in accordance with the present invention comprises a base 10, a die assembly 20, a driven shaft assembly 30, a restoring member 40, and a pressing handle 50.

The base 10 has a front end, a mounting recess 11, at least one positioning protrusion 12, a first coupling hole 13, and a second coupling hole 14. The mounting recess 11 is formed in the front end of the base 10. The at least one positioning protrusion 12 protrudes into the mounting recess 11. The first coupling hole 13 is formed in the base 10 and communicates with the mounting recess 11. The second coupling hole 14 is formed in the base 10 and does not communicate with the mounting recess 11.

The die assembly 20 is mounted in the mounting recess 11 of the base 10 and includes a lower die 21 and an upper die 22. The lower die 21 has at least one positioning hole 23. The at least one positioning hole 23 engages with the at least one positioning protrusion 12 of the base 10. The upper die 22 is disposed above the lower die 21 and corresponds in position to the first coupling hole 13.

The driven shaft assembly 30 is movably mounted in the first coupling hole 13 of the base 10 and abuts against the die assembly 20. The driven shaft assembly 30 includes a lower shaft unit 31, an upper shaft unit 32, and a cushion member 33. The lower shaft unit 31 is mounted in the first coupling hole 13 of the base 10, is able to move up and down relative to the base 10, and has an upper end and a lower end. The lower end of the lower shaft unit 31 abuts against the upper die 22 of the die assembly 20. The upper shaft unit 32 is coupled to the lower shaft unit 31 and is able to move up and down relative to the lower shaft unit 31. The cushion member 33 is mounted to the upper shaft unit 32 and has two ends. The two ends of the cushion member 33 respectively abut against the upper end of the lower shaft unit 31 and the upper shaft unit 32. Specifically, the cushion member 33 is a power spring.

The restoring member 40 is mounted in the second coupling hole 14 of the base 10 and has two ends. The two ends of the restoring member 40 respectively abut against the base 10 and the upper shaft unit 32.

The pressing handle 50 is pivotally coupled to the base 10 and has a pivot portion and a pushing portion 51. The pivot portion is pivotally connected to the base 10. The pushing portion 51 is formed adjacent to the pivot portion and abuts against the upper shaft unit 32.

With reference to FIGS. 2 and 3, in the preferred embodiment, the lower shaft unit 31 includes a main shaft 311, at least one oil retaining groove 312, an oil containing groove 316, and a necked portion 313. The main shaft 311 is tubular, is movably mounted in the first coupling hole 13, and has an outer surface and an inner surface. The outer surface of the main shaft 311 contacts the base 10. The at least one oil retaining groove 312 is formed in and around the outer surface of the main shaft 311. Each of the at least one oil retaining groove 312 is filled with lubricating oil and encircles an imaginary plane. The imaginary plane may be perpendicular to a central axis of the main shaft 311 or may be inclined relative to the central axis of the main shaft 311. The oil containing groove 316 is formed in and around the outer surface of the main shaft 311 and is disposed below the at least one oil retaining groove 312. The necked portion 313 protrudes from and is formed around the inner surface of the main shaft 311 and has a limit surface 314 and a first stop surface 315. The limit surface 314 faces toward an upper end of the main shaft 311. The first stop surface 315 faces toward a lower end of the main shaft 311.

The upper shaft unit 32 includes a connecting panel 321, an upper shaft 322, and a fastener 323. The connecting panel 321 has a through hole 324 formed through the connecting panel 321. The upper shaft 322 is mounted to the connecting panel 321 and is mounted through the through hole 324 of the connecting panel 321. The upper shaft 322 has a lower end and a lower end surface. The lower end of the upper shaft 322 protrudes into the main shaft 311. The lower end surface of the upper shaft 322 faces the limit surface 314. The fastener 323 is mounted through the necked portion 313, is fastened to the upper shaft 322, and has a second stop surface 325. The second stop surface 325 selectively abuts against the first stop surface 315.

As shown in FIGS. 2 and 3, specifically, the upper shaft 322 has an inner thread 326 formed in the upper shaft 322. The fastener 323 has an outer thread 327. The outer thread 327 passes through the necked portion 313 and engages with the inner thread 326.

Figure 4:
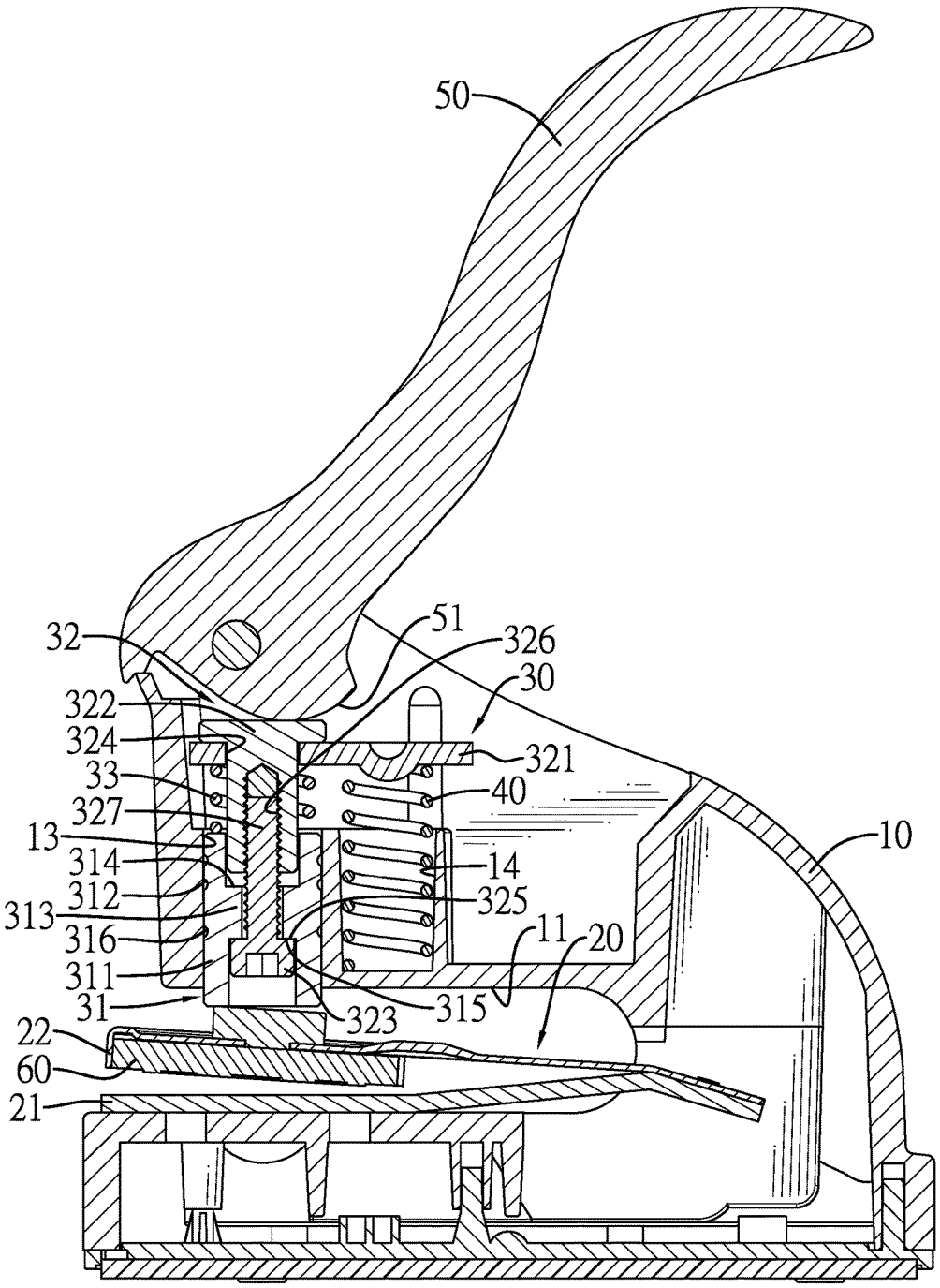
FIG. 4 is a cross-sectional side view of the embossing seal in FIG. 1, showing a die mounted therein.

With reference to FIG. 4, before embossing, a material 60 that is intended to be embossed is inserted between the upper die 22 and the lower die 21 of the die assembly 20 and is mounted on the upper die 22.

Figure 5:
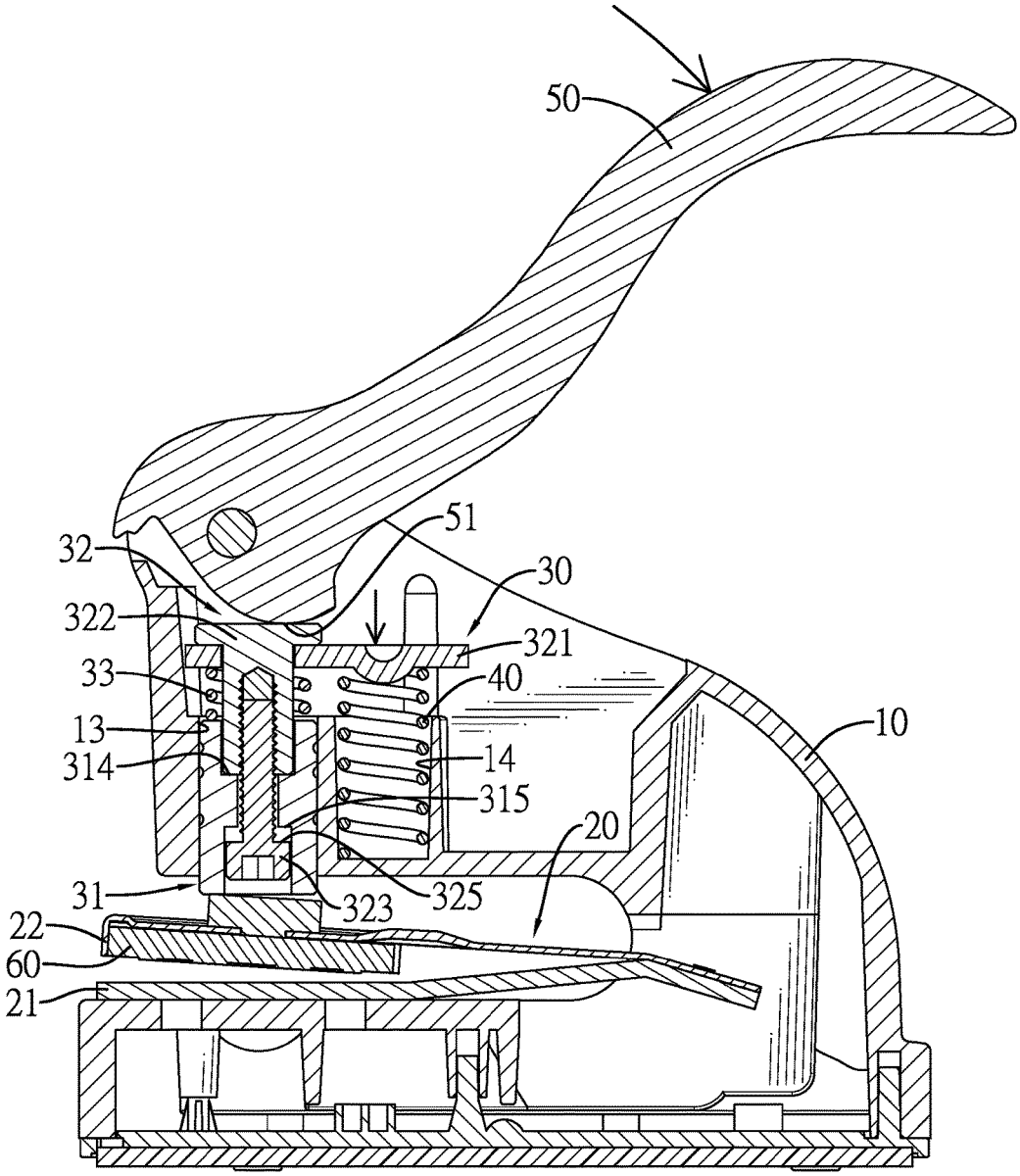
FIG. 5 is an operational cross-sectional side view of the embossing seal in FIG. 1.

With further reference to FIG. 5, a user turns the pressing handle 50 to allow the pushing portion 51 of the pressing handle 50 to depress the upper shaft 322 as well as the connecting panel 321 of the upper shaft unit 32 to move downward. Accordingly, the cushion member 33 and the restoring member 40 are compressed and the cushion member 33 pushes the lower shaft unit 31 to move downward. The lower shaft unit 31 that moves downward presses upon the upper die 22, so as to emboss patterns on the material 60. As the lower end of the upper shaft 322 abuts the limit surface 314 of the lower shaft unit 31, a first embossing step of the driven shaft assembly 30 is completed.

Figure 6:
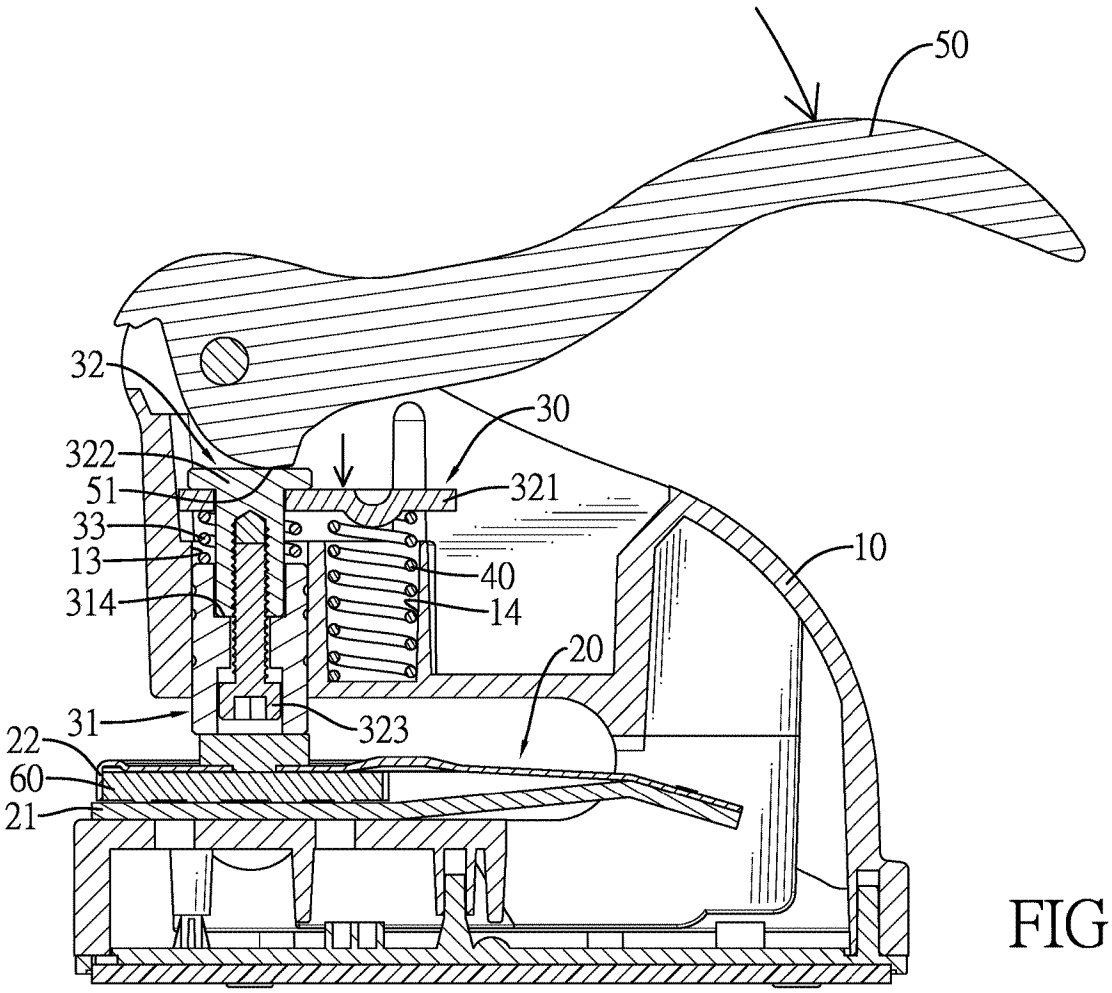
FIG. 6 is another operational cross-sectional side view of the embossing seal in FIG. 1

With reference to FIG. 6, when the user applies more downward force to depress the pressing handle 50 to perform a second embossing step, the pushing portion 51 of the pressing handle 50 and the upper shaft 322 directly push the main shaft 311 to move downward to press upon the upper die 22.

Afterwards, as the pressing handle 50 is turned to allow the pushing portion 51 to leave the upper shaft unit 32, the restoring member 40 and the cushion member 33 push the upper shaft unit 32 and the lower shaft unit 31 to move upward.

As shown in FIGS. 3 and 4, when the main shaft 311 moves in the first coupling hole 13 of the base 10, the lubricating oil in the at least one oil retaining groove 312 allows the main shaft 311 to move smoothly. Furthermore, the oil containing groove 316 can receive the lubricating oil that flows out from the at least one oil retaining groove 312.

The embossing seal as described has the following advantages. The driven shaft assembly 30 that includes the upper shaft unit 32 and the lower shaft unit 31 allows the user to perform the first and second embossing steps. During the first embossing step, with the upper shaft unit 32 driving the lower shaft unit 31 via the cushion member 33, discomfort to the wrist and elbow of the user can be reduced. Accordingly, the user can operate the embossing seal in a comfortable and labor saving manner.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An embossing seal comprising:
- a base having
  - a front end; and
  - a mounting recess formed in the front end of the base;
- a die assembly mounted in the mounting recess of the base;
- a driven shaft assembly movably mounted in the base and abutting against the die assembly, and the driven shaft assembly including
  - a lower shaft unit mounted in the base, being able to move up and down relative to the base, and having a lower end, and the lower end of the lower shaft unit abutting against the die assembly;
  - an upper shaft unit coupled to the lower shaft unit and being able to move up and down relative to the lower shaft unit; and
  - a cushion member mounted to the upper shaft unit and having two ends respectively abutting against the lower shaft unit and the upper shaft unit;
- a restoring member mounted in the base and having two ends respectively abutting against the base and the upper shaft unit; and
- a pressing handle pivotally coupled to the base and having
  - a pivot portion pivotally connected to the base; and
  - a pushing portion formed adjacent to the pivot portion and abutting against the upper shaft unit.

2. The embossing seal as claimed in claim 1, wherein the lower shaft unit includes:
- a main shaft being tubular;
- at least one oil retaining groove formed in and around an outer surface of the main shaft; and
- a necked portion protruding from and formed around an inner surface of the main shaft and having
  - a limit surface facing toward an upper end of the main shaft; and
  - a first stop surface facing toward a lower end of the main shaft; and the upper shaft unit includes:
- a connecting panel having a through hole formed through the connecting panel;
- an upper shaft mounted to the connecting panel, mounted through the through hole of the connecting panel, and having
  - a lower end protruding into the main shaft; and
  - a lower end surface facing the limit surface; and
- a fastener mounted through the necked portion, fastened to the upper shaft, and having a second stop surface, and the second stop surface selectively abutting against the first stop surface.

3. The embossing seal as claimed in claim 2, wherein each of the at least one oil retaining groove encircles an imaginary plane being perpendicular to a central axis of the main shaft.

4. The embossing seal as claimed in claim 3, wherein the lower shaft unit further includes an oil containing groove, and the oil containing groove is formed in and around the outer surface of the main shaft and is disposed below the at least one oil retaining groove.

5. The embossing seal as claimed in claim 4, wherein the upper shaft has an inner thread formed in the upper shaft; and the fastener has an outer thread, and the outer thread passes through the necked portion and engages with the inner thread.

6. The embossing seal as claimed in claim 3, wherein the upper shaft has an inner thread formed in the upper shaft; and the fastener has an outer thread, and the outer thread passes through the necked portion and engages with the inner thread.

7. The embossing seal as claimed in claim 2, wherein each of the at least one oil retaining groove encircles an imaginary plane inclined relative to the central axis of the main shaft.

8. The embossing seal as claimed in claim 7, wherein the lower shaft unit further includes an oil containing groove, and the oil containing groove is formed in and around the outer surface of the main shaft and is disposed below the at least one oil retaining groove.

9. The embossing seal as claimed in claim 8, wherein the upper shaft has an inner thread formed in the upper shaft; and the fastener has an outer thread, and the outer thread passes through the necked portion and engages with the inner thread.

10. The embossing seal as claimed in claim 7, wherein the upper shaft has an inner thread formed in the upper shaft; and the fastener has an outer thread, and the outer thread passes through the necked portion and engages with the inner thread.

11. The embossing seal as claimed in claim 2, wherein the lower shaft unit further includes an oil containing groove, and the oil containing groove is formed in and around the outer surface of the main shaft and is disposed below the at least one oil retaining groove.

12. The embossing seal as claimed in claim 11, wherein the upper shaft has an inner thread formed in the upper shaft; and the fastener has an outer thread, and the outer thread passes through the necked portion and engages with the inner thread.

13. The embossing seal as claimed in claim 2, wherein the upper shaft has an inner thread formed in the upper shaft; and the fastener has an outer thread, and the outer thread passes through the necked portion and engages with the inner thread.

* * * * *